US005559422A

United States Patent [19]

Fahrenkrug et al.

[11] Patent Number: 5,559,422

[45] Date of Patent: Sep. 24, 1996

[54] WALL TRANSFORMER

[75] Inventors: Corinn Fahrenkrug, Liverpool; Shawn Briggman, Syracuse, both of N.Y.

[73] Assignee: Welch Allyn, Inc., Skaneateles Falls, N.Y.

[21] Appl. No.: 270,139

[22] Filed: Jul. 1, 1994

[51] Int. Cl.[6] ..... G05F 1/10

[52] U.S. Cl. ..... 323/221; 323/226; 323/902; 323/911

[58] Field of Search ..... 363/89; 323/221, 323/226, 223, 274, 281, 902, 911

[56] References Cited

U.S. PATENT DOCUMENTS 4,349,777 9/1982 Mitamura ..... 323/226

4,825,357 4/1989 Vesugi ..... 363/79

5,260,644 11/1993 Curtis ..... 323/226

FOREIGN PATENT DOCUMENTS 1067487 1/1984 U.S.S.R. .

*Primary Examiner*—Peter S. Wong

*Assistant Examiner*—Shawn Riley

*Attorney, Agent, or Firm*—Harris Beach & Wilcox

[57] ABSTRACT

A wall mounted power supply for a remote instrument handle has a novel self compensating voltage regulating circuit that remains in precise calibration despite variable voltage drops in the load, cabling, and control switches. Power output is enabled by an infrared emitter-detector combination disposed in the device's cradle that senses the absence of the instrument handle therein.

15 Claims, 4 Drawing Sheets

WALL TRANSFORMER

BACKGROUND OF THE INVENTION

1. Field of the Invention

This invention relates to a wall transformer unit. More particularly this invention relates to a wall transformer unit for supplying regulated voltage to a handle connected thereto by an electrical cable. The handle attaches to an instrument that requires closely regulated power.

2. Description of the Prior Art

Wall transformer units for supplying power to hand-held instruments are required to supply highly regulated voltages in certain applications, such as medical instrumentation. Wall transformer units are typically calibrated at the factory. After a period of use, however, changes in resistance which occur as a result of aging, or as a result of the use of replacement parts, can cause variations in the output voltage that appears across the load at the handle.

Conventional wall transformer designs place an on/off switch in series with a power rheostat and in series with the load. Often a series microswitch is included in the circuit to activate the unit when the handle is disengaged from its cradle. The precision of the power rheostat is often poor, particularly at the minimal resistance extreme of its range, and at times a trimmer resistor is included elsewhere in the circuit to compensate. Nevertheless, replacement of components such as the coiled cord that extends from the wall unit to the handle, and aging effects are sufficient to produce an unacceptable variation in the output voltage. Recalibrating the trimmer is then necessary, but is inconvenient, and often not feasible in the field.

One known prior art device has attempted to deal with the problem of output voltage variation by an arrangement that employs a rheostat that is not in series with the load. However this device has the drawback of employing a carbon element in the rheostat that is imprecise in the region of minimal resistance. Furthermore the unit employs a series microswitch that has a non-zero resistance, which adversely affects calibration of the unit.

It is required in wall transformer units that the output turn on automatically when the handle is removed from its cradle on the unit. In past implementations, there was a fundamental problem in achieving this with a microswitch, because mechanical switches require more actuation force than that created by the weight of the handle. The prior art offers two typical solutions. In one approach the actuation force is artificially reduced by adding additional length to the microswitch actuating arm. This produces more leverage for the handle to work against, but decreases reliability, increases component variability and increases cost due to the extra parts. In another approach, a locking feature is added in the cradle, and the handle is held against the switch actuating arm with additional force. This also allows the product to function, but seriously decreases the ease of use. Instead of merely lifting the handle, the user must "pry" it out of its lock. In medical applications where there is high frequency of use and time is critical (e.g. hospital emergency rooms, clinics, etc.) the lock becomes an impediment, and is therefore a major disadvantage.

SUMMARY OF THE INVENTION

It is therefore a primary object of the present invention to provide a wall transformer unit that produces an regulated output voltage that is independent of variations in the resistances of internal components.

It is another object of the present invention to provide a wall transformer unit that is reliably and easily actuated by removal of its diagnostic handle and has few mechanical parts.

These and other objects of the present invention are attained by a power supply unit for supplying regulated power to a remote location that includes a transformer, a rectifier connected to the transformer for producing a direct current output, a cable connecting the unit to the remote location or to an instrument handle for conveying rectified electrical power to a load thereat, and a cradle for cradling the handle thereon when the handle is not in use.

In one aspect of the invention a voltage regulating circuit is connected to an output of the rectifier which employs a reference voltage source. A transistor is connected in series with the rectifier and the load. A voltage divider is connected across the load and includes a rheostat positioned in the remote instrument handle. A first differential amplifier has the noninverting input connected to the voltage divider, and the inverting input connected to the adjusted low rail applied to the load. The output of the first differential amplifier is responsive to voltage drops in the load and also in the rheostat. A second differential amplifier has the noninverting input connected to the reference voltage, and the inverting input connected to the output of the first differential amplifier. The second differential amplifier produces an error signal that is proportional to the difference between the reference voltage and the output at the load measured by the first differential amplifier. The error signal is connected to the base of the transistor to vary the conductive state thereof. The voltage drop across the load varies according to the conductive state of the transistor as modulated by the error output of the second differential amplifier.

In another aspect of the invention an optical switch is disposed in the cradle and connected to the voltage regulating circuit. This switch enables and disables the supply of power to the load by enabling and disabling the reference voltage source according to whether the switch is on or off. The switch is in a non-series connection with the load. It includes an infrared radiation emitter, and an infrared radiation detector that receives infrared radiation from the radiation emitter via an optical path that is occluded and completed as the handle reposes in the cradle and is removed therefrom.

In this arrangement the voltage of the power supplied to the load is independent of voltage drops in the cable and in the optical switch.

BRIEF DESCRIPTION OF THE DRAWING

For a better understanding of these and other objects of the present invention, reference is made to the detailed description of the invention which is to be read in conjunction with the following drawings, wherein.

DESCRIPTION OF THE PREFERRED EMBODIMENT

Figure 1:
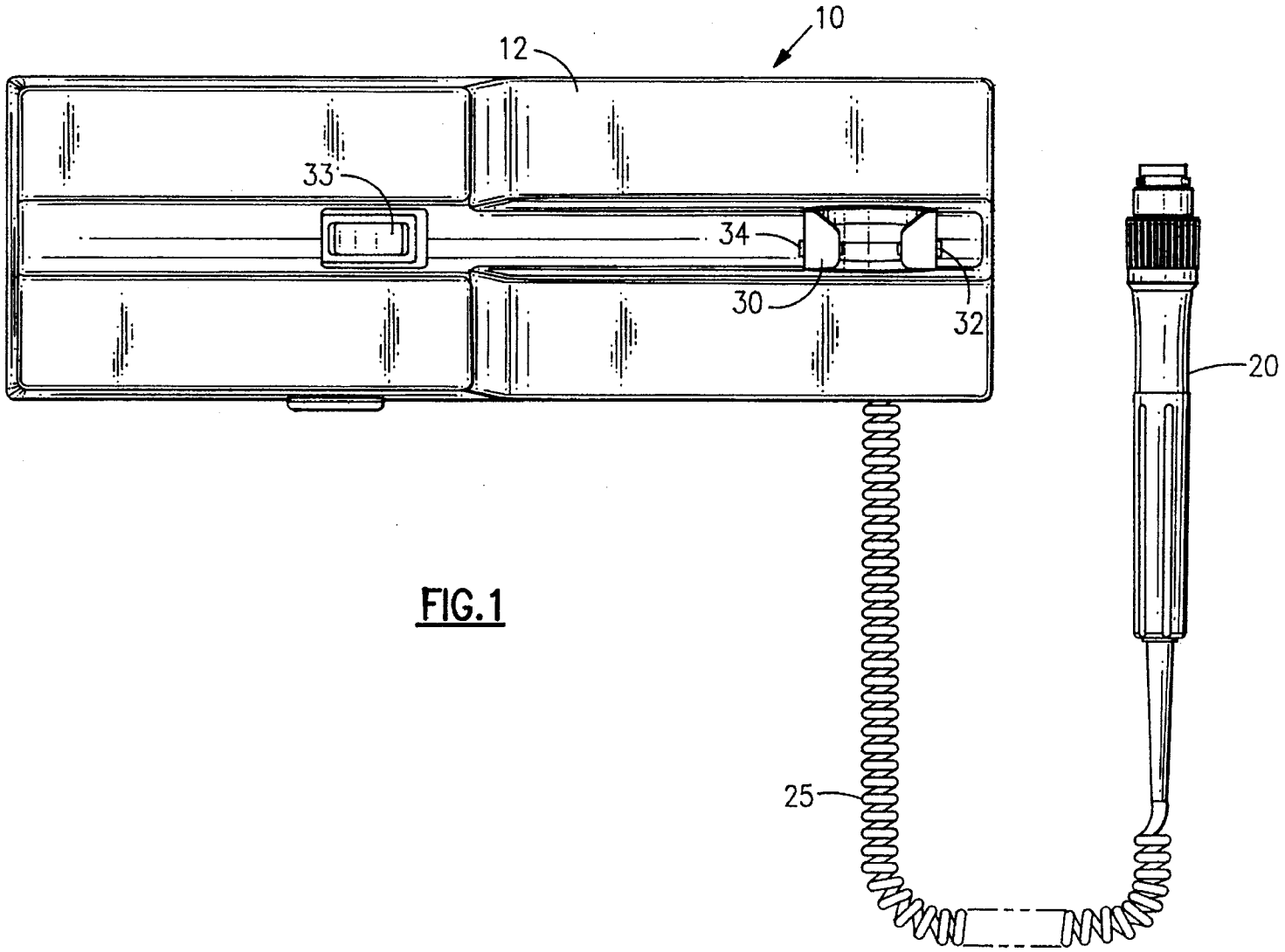
FIG. 1 is a front view of a wall transformer unit embodying the teachings of the invention with the handle removed from its cradle.

Turning now to the FIG. 1 of the Drawing, there is shown a wall transformer unit embodying the teachings of the invention. The unit has a housing 12 that is mounted on a wall (not shown) and connected to a source of power. The unit is actuated by a main power switch 33. A diagnostic handle 20 is adapted to connect with various interchangeable instruments (not shown), such as medical ophthalmoscope or otoscope heads. A coiled cord 25 connects the handle 20 to the housing 12 for transmitting power to the handle for use by the instruments. This cord, or its connections may fail during long repeated use of the device, and is designed to be replaceable. It is common, however, for replacement cords to vary in their resistance, which results in differing voltage drops. If not properly compensated, the unit will not be in calibration after such a replacement. A cradle 30 is provided on the housing 12 for holding the handle 20 when the latter is not in use. An optical emitter/detector combination 32, 34 is disposed in the cradle 30 to sense the presence of the handle 20 thereon.

Figure 2:
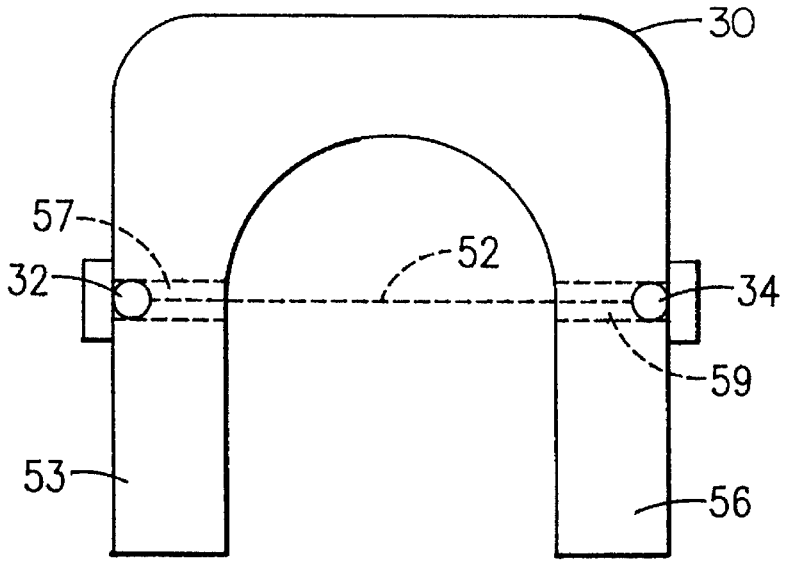
FIG. 2 is an enlarged sectional top view of a cradle of the type illustrated in the unit of FIG. 1.
Figure 3:
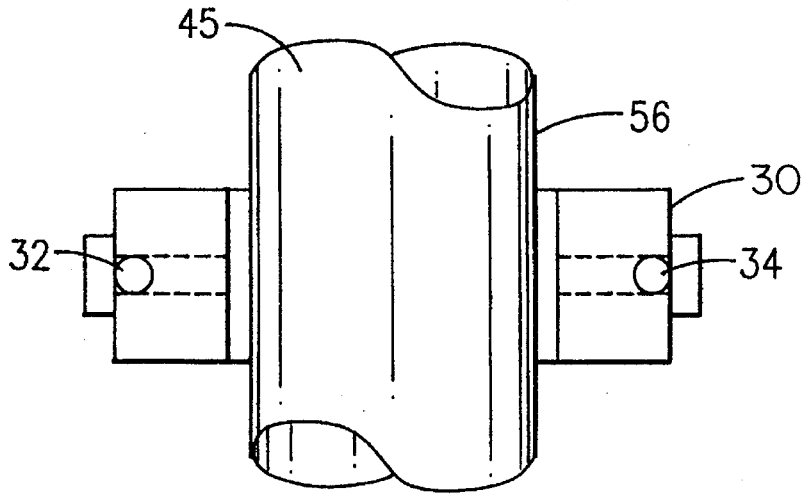
FIG. 3 is a partial front view of the cradle shown in FIG. 2 with a handle reposing therein.

Turning now to FIGS. 2 and 3 there is shown a cradle 30 that can be used with the wall transformer unit 10. An infrared light emitting diode 32 is mounted within a through hole 57 bored through an arm 53 of the cradle. Another through hole 59 is bored through the opposing arm 56 and contains a photodetector 34 that is sensitive to the infrared light emitted by the diode 32. When a handle 20 is lifted out of the cradle, as in FIG. 2, a light beam 52 is directed across the cradle from the diode 32 to strike the photodetector 34 which produces a signal responsive thereto. When the handle 20 reposes in the cradle (FIG. 3), it obstructs the light beam 52, and the signal emitted by the photodetector 34 changes state. The electronic circuitry that is located within the housing 12 and discussed in further detail hereinbelow senses the state of the signal produced by the photodetector 34.

Output Regulation

Figure 4:
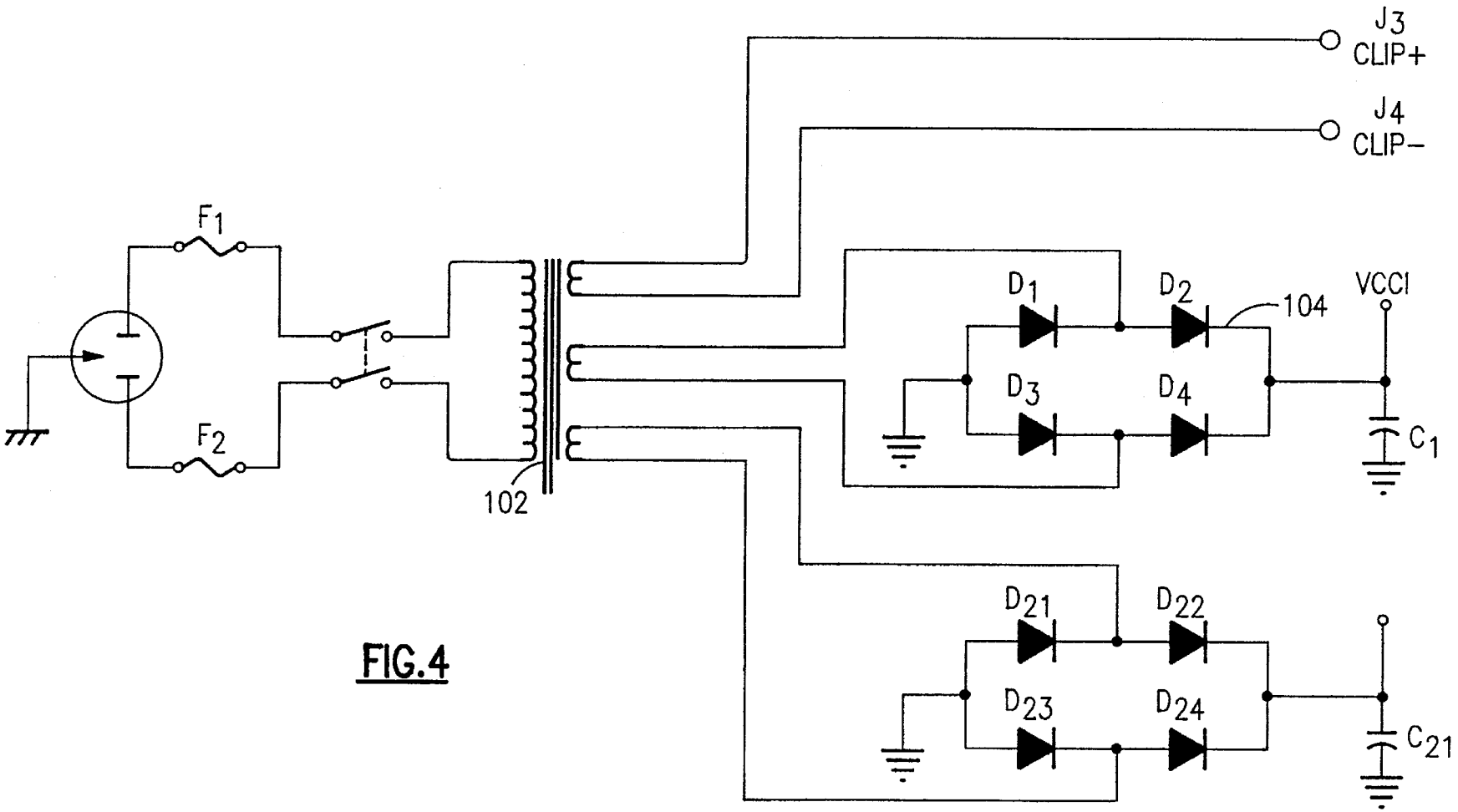
FIG. 4 is an electrical schematic of a portion of a power supply for the unit of FIG. 1.
Figure 5:
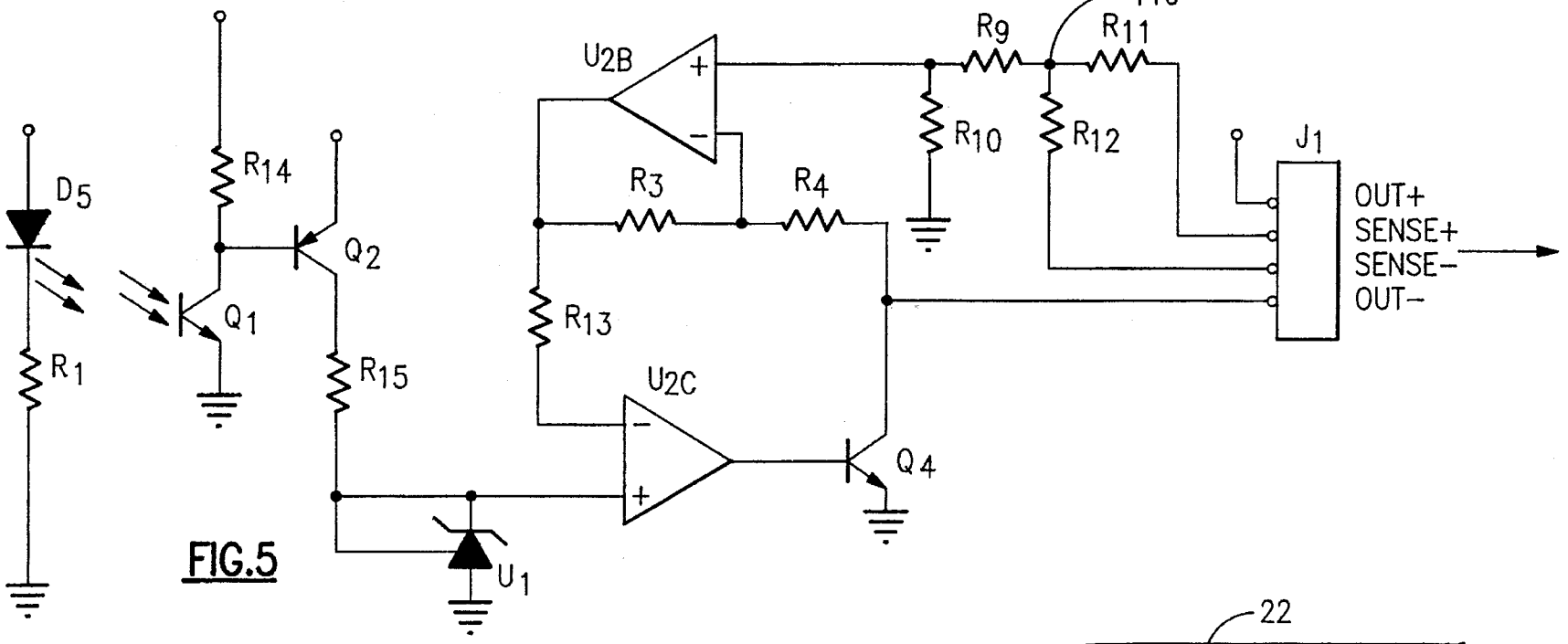
FIG. 5 is an electrical schematic of a voltage regulation circuit that is connected to the circuit shown in FIG. 4.
Figure 6:
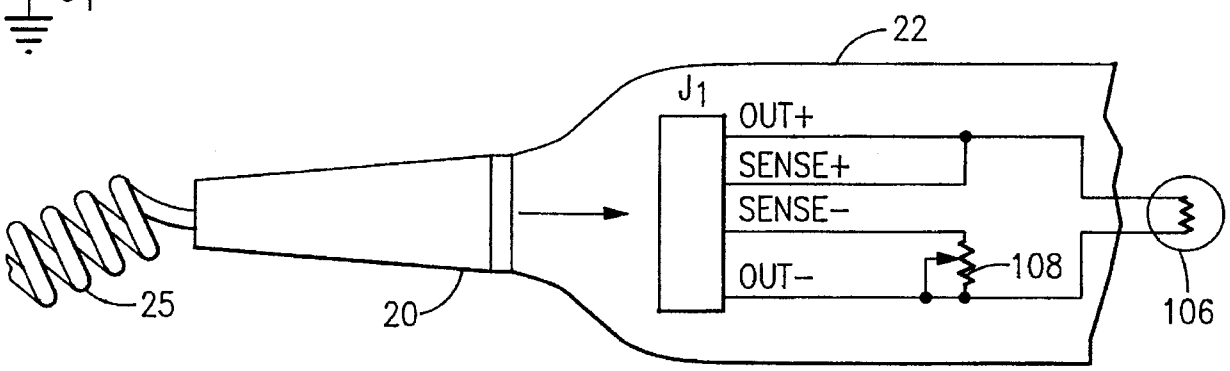
FIG. 6 is a partially schematic view of the handle shown in FIG. 1 with an instrument attached.

Turning now to FIGS. 4–6, there is shown a circuit which is designed to control the power output to a lamp 106 at the end of a long coiled cord 25 at a constant target voltage independent of current draw, contact and component loss, and other component variation.

In this circuit, the output of a transformer 102 is full wave rectified by a diode bridge 104 and filtered by C1. This produces a rough DC output voltage VCC1 having significant ripple. The top rail of this supply is connected directly to the high side of the lamp 106 at terminal OUT+ of jack J1. The bottom side of the output, which appears at terminal OUT– of jack J1, is determined by the state of output transistor Q4. As Q4 approaches saturation, the lower rail OUT– applied to the lamp 106 approaches ground and increases the output to the lamp. By properly controlling Q4, the output to the lamp 106 is maintained at the target.

The control to Q4 is determined by the output of operational amplifier U2C. This amplifier produces an error signal which is the differential output sensed at the gamp by operational amplifier U2B and the reference target. The differential output is derived from the low current sense lead voltages which measure output as it appears at the lamp. The resistor network R11 and R12 together with the resistance of rheostat 108, $R_{rheo}$, sets up a divider network which varies as the rheostat resistance varies. This differential output is at its maximum when the rheostat 108 is at its minimum. The output decreases as the rheostat value increases according to the ratio of R11 to R12+$R_{rheo}$. Rheostat 108 has a conductive plastic element, and is chosen because it has a reliable, very low minimum resistance, which is repeatable after large numbers of cycles. It should be noted that the voltage appearing at point 110 is offset by the saturation voltage of Q4.

Because the circuit control is based on the voltage returned on the sense leads at terminals SENSE+ and SENSE– of jack J1, it compensates automatically for the voltage drop in all components in the output path up to the sense leads. Secondly, the critical output level to be controlled is the maximum voltage provided. Since this occurs when the rheostat 108 is at its minimum, the absolute minimum resistance of the rheostat 108 is a potential cause of variation in the output. In addition, even if this variation is compensated for initially, the typical wear and variation over time which occurs with conventional rheostats causes the unit to gradually degrade in performance. In previous art this was resolved typically by adding a potentiometer in the circuit (e.g., in line with R12) to force the minimum resistance level to some calibrated level. This addressed the problem of the initial output, but the long term performance degradation was not resolved. In other cases, the maximum output is calibrated to the maximum position of the rheostat and again, the short term performance can be achieved, but the long term performance still degrades.

The approach of the circuit of FIGS. 4–6 is that, rather than pursuing either a higher accuracy rheostat or adding a calibrating potentiometer, high output accuracy is achieved by making use of the repeatability and long term stability of an off-the-shelf conductive plastic rheostat. Because of its repeatable absolute minimum resistance, and its long term reliability, the circuit requires no additional potentiometer to calibrate initially, and maintains its performance over time. It will also be appreciated by those skilled in the art that the calibrating potentiometer 108 is not in series with the output, and therefore does not require a high power rating. Nor is the optical sensor in series with the output, so that the output voltage is independent of the variation in these two components, improving the output accuracy and repeatability for various loads. The reference provides a calibrating voltage which is insensitive to moderate variations in current.

It has been found that placing the rheostat 108 remotely in the handle 20, or in an adapter 22 for a medical instrument (see FIG. 6) achieves more consistent light output, and lamp life. This arrangement allows a plurality of handle-cord combinations to be independently calibrated and interchanged with one another on the same unit, and also allows several handles and cords to be attached and simultaneously operated from the same unit, each being independently calibrated by adjusting its own remotely positioned rheostat.

Cradle ON/OFF Switching

By using an optical switch configuration such as that implemented in FIG. 2, both the cost and the ease of use are maintained and the reliability is increased as compared with the prior art. The circuit that enables the channel output also enables the reference voltage. The supply current needed to run the reference is produced by the optical sensor, phototransistor Q1. When the handle is removed an infra-red IR beam is emitted from the light emitting diode D5 is sensed by Q1, Q1 drives current amplifier Q2, which in turn is coupled to Zener diode U1 to generate the target reference voltage that appears at the input of U2C. Q2 is held off by R14, and only conducts when Q1 conducts sufficiently to overcome R14, thereby driving current into the reference.

When the voltage on input 10 of U2C is not at its reference value, the output of U2C will be low, so that Q4 is cut off. The voltage at terminal OUT– of J1 will then equal VCC1, so that the lamp 106 sees no output.

When Q1 conducts, Q2 is driven on, and provides sufficient current amplification to drive the reference into saturation. Q2 is needed because Q1 alone cannot meet the current drive requirements to drive the reference into a stable condition. The reference requires about 2 ma at its specified voltage accuracy.

To use the invention, it is simply necessary to connect the wall transformer unit 10 to a suitable source of power, and to attach a desired medical diagnostic instrument to the diagnostic handle 20. When the handle is removed from its cradle 30, the lamp will be enabled, and the operator can then apply the medical instrument to its task.

While this invention has been explained with reference to the structure disclosed herein, it is not confined to the details set forth and this application is intended to cover any modifications and changes as may come within the scope of the following claims:

What is claimed is:

1. In an apparatus of the type having a power supply unit including a voltage regulator circuit, an instrument handle adapted to be connected to a load, a cable for conveying electrical power from said power supply unit to said instrument handle and load, and a cradle mounted on said power supply unit for holding said handle when said handle is not in use, the improvement comprising:

variable resistance means, disposed within said handle, and connected in a non-series relationship with said load, for adjusting the output voltage of said voltage regulator circuit through said cable;

switching means attached to said cradle for interrupting the supply of power to said load when said handle reposes in said cradle, said switching means being in a non-series connection with said load;

whereby the voltage supplied to said load is independent of the voltage drop in said cable.

2. The apparatus of claim 1 in which said switching means includes a radiation emitter connected to said cradle and a radiation detector connected to said cradle, the path between said radiation emitter and radiation detector being occluded when said handle reposes in said cradle.

3. The apparatus of claim 2 wherein said radiation emitter comprises an infrared light emitting diode and said radiation detector is sensitive to infrared light.

4. The apparatus of claim 3 wherein said radiation detector comprises a phototransistor.

5. The apparatus of claim 1 wherein said variable resistance means comprises a potentiometer of the conductive plastic type.

6. The apparatus of claim 1 wherein said cable includes first and second power conductors and at least one sensing conductor, and wherein said variable conducting means adjusts the output voltage of said regulator circuit via said at least one sensing conductor.

7. The apparatus of claim 1 wherein said voltage regulating circuit comprises:

a reference voltage source that is enabled by said switching means;

a transistor having an input and an output in a series connection with the load;

a voltage divider connected across the load, said variable resistance means being a part of said voltage divider;

circuit means connected to said voltage divider and said reference voltage source for producing an error signal for application to a control element of said transistor;

whereby the voltage drop across the load is responsive to the error signal applied to said control element.

8. The apparatus of claim 7 wherein said circuit means comprises:

a first differential amplifier having a first input connected to the load, whereby an output of said first differential amplifier is responsive to the voltage drop across the load and to said variable resistance means;

a second differential amplifier having a first input connected to said reference voltage source and a second input connected to said output of said first differential amplifier, and having an error output that is responsive to the difference voltage between said reference voltage source and said output of said first differential amplifier.

9. The apparatus of claim 7 wherein said switching means enables said reference voltage source by conducting electrical current therethrough.

10. An apparatus including, in combination:

a power supply unit including a voltage regulator circuit, an instrument handle to which an electrical load may be attached, a multi-conductor cable for electrically connecting said power supply unit to said instrument handle and load, said cable including first and second power conductors for supplying operating current to said load and at least one sensing conductor;

a cradle mounted on said power supply unit for holding said handle when said handle is not in use;

adjusting means, disposed within said handle and connected across said load, for adjusting the output voltage of said voltage regulator circuit via said sensing conductor;

light responsive switching means attached to said cradle for preventing said voltage regulating circuit from supplying operating current through said power conductors when said handle is in said cradle;

whereby the voltage across said load is substantially independent of the voltage drops along said power conductors.

11. The apparatus of claim 10 wherein said switching means includes a radiation emitter connected to said cradle and a radiation detector connected to said cradle, the path between said radiation emitter and detector being occluded when said handle reposes in said cradle.

12. The apparatus of claim 10 wherein said switching means is not connected in series with said power conductors.

13. The apparatus of claim 10 wherein said voltage regulating circuit includes a reference voltage source, and wherein said switching means is connected in disabling relationship to said reference voltage source.

14. The apparatus of claim 10 in which said adjusting means includes a variable resistor and a knob attached to said handle for varying the resistance of said variable resistor.

15. In an apparatus of the type having a power supply unit, an instrument handle adapted to be connected to a load, a cable for conveying electrical power from said power supply unit to said instrument handle and load, and a cradle mounted on said power supply unit for holding said handle when said handle is not in use, the improvement comprising:

a rheostat disposed in said instrument handle, said rheostat being in a non-series connection with said load;

a voltage regulating circuit disposed in said power supply unit for regulating the output voltage supplied to the load through said cable, said circuit comprising:

a reference voltage source;

a transistor having an input and an output in a series connection with said load;

a voltage divider connected across the load, said rheostat comprising a part of said voltage divider;

a first differential amplifier having a first input connected to said voltage divider, and a second input connected to the load; and a second differential amplifier having a first input connected to said reference voltage source, and a second input connected to the output of said first differential amplifier, and having an error output that is responsive to a difference between said reference voltage and said output of said first differential amplifier, said error output being applied to a control element of said transistor;

whereby the voltage drop across the load is controlled by said transistor in accordance with the error output of said second differential amplifier;

switching means disposed in the cradle and connected to said voltage regulating circuit for enabling and disabling a supply of power to the load and said reference voltage source, said switching means being in a non-series connection with the load and comprising:

an infrared radiation emitter; and an infrared radiation detector that receives radiation from said radiation emitter via a path that is blocked by the handle when the handle reposes in the cradle;

whereby the voltage of the power supplied to the load is independent of the voltage drop in said cable.

* * * * *